US010083812B1

(12) United States Patent
Mackie et al.

(10) Patent No.: US 10,083,812 B1
(45) Date of Patent: Sep. 25, 2018

(54) THERMIONIC-ENHANCED FIELD EMISSION ELECTRON SOURCE COMPOSED OF TRANSITION METAL CARBIDE MATERIAL WITH SHARP EMITTER END-FORM

(71) Applicant: Applied Physics Technologies, Inc., McMinnville, OR (US)

(72) Inventors: William A. Mackie, McMinnville, OR (US); Gerald G. Magera, Hillsboro, OR (US); Joshua M. Lovell, Carlton, OR (US)

(73) Assignee: Applied Physics Technologies, Inc., McMinnville, OR (US)

( * ) Notice: Subject to any disclaimer, the term of this patent is extended or adjusted under 35 U.S.C. 154(b) by 49 days.

(21) Appl. No.: 15/359,436

(22) Filed: Nov. 22, 2016

Related U.S. Application Data

(60) Provisional application No. 62/263,457, filed on Dec. 4, 2015.

(51) Int. Cl.
*H01J 1/304* (2006.01)
*H01J 9/02* (2006.01)

(52) U.S. Cl.
CPC ..... *H01J 1/3044* (2013.01); *H01J 9/025* (2013.01); *H01J 2201/30407* (2013.01); *H01J 2201/30484* (2013.01); *H01J 2209/0223* (2013.01)

(58) Field of Classification Search
CPC .. H01J 1/3044; H01J 9/025; H01J 2209/0223; H01J 2201/30407; H01J 2201/30484; H01J 19/062; H01K 1/10
See application file for complete search history.

(56) References Cited

U.S. PATENT DOCUMENTS 4,193,013 A 3/1980 Futamoto et al.
4,430,570 A 2/1984 Takigawa et al.
4,486,684 A 12/1984 Hohn
(Continued)

FOREIGN PATENT DOCUMENTS

JP 56018336 A 2/1981
WO WO 2013152613 A1 * 10/2013 ..... H01J 1/304

*Primary Examiner* — Joseph L Williams
*Assistant Examiner* — Jose M Diaz
(74) *Attorney, Agent, or Firm* — Stoel Rives LLP

(57) ABSTRACT

An electron source emitter is made from transition metal carbide materials, including hafnium carbide (HfC), zirconium carbide (ZrC), titanium carbide (TiC), vanadium carbide (VC), niobium carbide (NbC), and tantalum carbide (TaC), which are of high refractory nature. Preferential evaporating and subsequent development of different crystallographic planes of the transition metal carbide emitter having initially at its apex a small radius (50 nm-300 nm) develop over time an on-axis, sharp end-form or tip that is uniformly accentuated circumferentially to an extreme angular form and persists over time. An emitter manufactured to the (110) crystallographic plane and operating at high electron beam current and high temperature for about 20 hours to 40 hours results in the (110) plane, while initially not a high emission crystallographic orientation, developing into a very high field emission orientation because of the geometrical change. This geometrical change allows for a very high electric field and hence high on-axis electron emission.

18 Claims, 3 Drawing Sheets

(56) References Cited

U.S. PATENT DOCUMENTS

| | | | | |
|---|---|---|---|---|
| 5,897,790 | A * | 4/1999 | Koga | H01J 9/025 216/11 |
| 6,682,383 | B2 | 1/2004 | Cho et al. | |
| 9,240,301 | B1 | 1/2016 | Mackie et al. | |
| 2004/0119023 | A1 | 6/2004 | Nakasuji et al. | |
| 2004/0144922 | A1* | 7/2004 | Hayashibara | H01J 37/02 250/310 |
| 2009/0110951 | A1* | 4/2009 | Kuo | B82Y 35/00 428/600 |
| 2010/0194262 | A1 | 8/2010 | Nonogaki et al. | |
| 2015/0054398 | A1* | 2/2015 | Yan | H01J 1/304 313/341 |

* cited by examiner

THERMIONIC-ENHANCED FIELD EMISSION ELECTRON SOURCE COMPOSED OF TRANSITION METAL CARBIDE MATERIAL WITH SHARP EMITTER END-FORM

COPYRIGHT NOTICE

© 2016 Applied Physics Technologies, Inc. A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR § 1.71(d).

TECHNICAL FIELD

This disclosure relates to sources of thermionic-enhanced field emission and, in particular, to an electron source that is made from transition metal carbide material with a sharp emitter end-form.

BACKGROUND INFORMATION

A commercially available standard Schottky electron source, Zr/O/W(100), uses the natural tendency of the tungsten (W) substrate material to re-form during processing to create a flat facet composed of the (100) crystallographic plane. During operation, a specific combination of temperature and electric field allows diffusion of zirconium (Zr) and oxygen (O) to create a low work function on the (100) facet plane at the apex of the emitter tip. This (100) facet or flat is responsible for the low work function in the presence of Zr and O and shapes the electric field at the apex. The work function and geometrical stability of currently available commercial sources of Zr/O/W(100) electron emitters is dependent on temperature, electric field, and vacuum levels. Because of this dependence, Zr/O/W(100) electron sources are limited in the amount of current they can emit. Such limitation can be defined as total beam current, angular intensity, brightness, or reduced brightness. Currently available Zr/O/W(100) electron sources are limited to angular intensities of 0.2 mA/sr (milliamps/steradian) to 1.0 mA/sr and typically operate at 0.5 mA/sr electron beam emission and 150 μA-200 μA total electron emission. Commercially available electron sources made from tungsten substrate material manufactured to the (310) crystallographic plane also exhibit the characteristic low work function. The (110) plane of a tungsten substrate material has no utility in operation as an electron source.

SUMMARY OF THE DISCLOSURE

This application discloses an electron source that is made from transition metal carbide materials, including hafnium carbide (HfC), zirconium carbide (ZrC), titanium carbide (TiC), vanadium carbide (VC), niobium carbide (NbC), and tantalum carbide (TaC). These transition metal carbide materials are of high refractory nature, and certain crystallographic planes (e.g., (100) and (210) planes) of these materials exhibit relatively low work functions. Although the carbide substrate material is very robust, applicant has observed evidence of preferential evaporation, which gives the end-form surface an angular appearance. Preferential evaporating and subsequent development of different crystallographic planes of a transition metal carbide emitter having initially at its apex a small radius (50 nm-300 nm) develop over time an on-axis, sharp end-form or tip that is uniformly accentuated circumferentially to an extreme angular form.

An example is the (110) crystallographic plane, which develops into a rather sharp point that persists over time. An emitter manufactured to the (110) plane and operating at high electron beam current for about 20 hours to about 40 hours results in the (110) plane, while initially not a high emission crystallographic orientation, quickly developing into a very high field emission orientation because of the geometrical change. This geometrical change allows for a very high electric field and hence high on-axis electron emission. A secondary benefit is that the total electron beam current is quite low, which is advantageous in electron sources because most of the electron emission is concentrated in the final beam and is not wasted as electron emission at odd angles and directions.

The disclosed electron source made from transition metal carbide material is especially useful when installed in a scanning electron microscope (SEM) performing advanced imaging applications that require a high brightness, high beam current source. Examples of such applications include neuroimaging and imaging electronic circuitry.

Additional aspects and advantages will be apparent from the following detailed description of preferred embodiments, which proceeds with reference to the accompanying drawings.

DETAILED DESCRIPTION OF PREFERRED EMBODIMENTS

Figure 1:
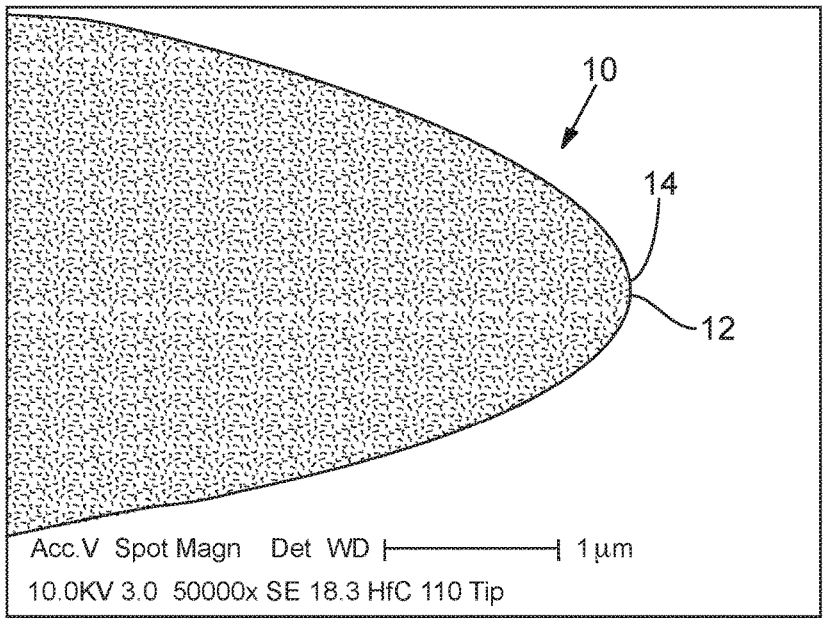
FIG. 1 is a rendering of a magnified (50000×) SEM micrograph image showing a side elevation view of the round end-form shape of the apex of an electrochemically etched HfC(110) field emission electron source before being placed in operation.

When working with HfC emitters operating in the Schottky mode, applicant noted geometrical changes on the surfaces of the emitter tips. The geometrical changes are somewhat akin to faceting but appear to result from preferential evaporation rather than redistribution of atoms on the emitter tip surface, as is the case with tungsten (commercial Schottky) sources. Certain crystallographic planes of transition metal carbide emitters evaporate more readily than others and thereby leave features at the apex of the emitter. The occurrence of geometrical change is less true for larger radius (i.e., greater than 300 nm) emitters. Operating emitters with smaller radii (i.e., 50 nm-300 nm) causes occurrence of preferential evaporation that re-forms the tip end. This re-forming of the emitter tip tends to flatten some crystallographic planes, especially the (100) planes and (111) planes, and tends to form edges that are sharper than those formed with the original end radius. The (110) plane is located between the two expanding (100) planes and two expanding (111) planes and, therefore, is the one that appears to sharpen the most. Flattening the (100) planes and (111) planes surrounding the (110) plane suppresses electron emission on most of the surrounding planes and thereby results in a reduced total electron emission (which is desirable) and an even higher beam or on-axis electron emission from the (110) plane (which is more desirable). The increased emission from the (110) emitter apex results primarily from the increased electric field that follows from the smaller radius at the (110) emitter apex.

A preferred embodiment is an HfC group thermionic-enhanced field emission electron source initially having an apex with a 100 nm-200 nm radius formed on-axis on the (110) plane. After about 20 hours-40 hours of burn-in operation at high electron beam emission, e.g., 0.5 mA/sr or greater, and at between about 1850° K and about 1900° K, a relatively sharp central protrusion characterized as a small radius end-form or tip forms at the apex, where there is high electric field emission and hence high electron emission at high angular intensity. The relatively sharp central protrusion is formed at a corner of a distorted cube defined by an intersection of two (100) planes and two (111) planes of the substrate. The radius of curvature of the relatively sharp protrusion is less than about 100 nm and preferably between about 20 nm and about 80 nm. The all-planar formation diminishes side (i.e., off-axis) emission with greater electron beam current but with less total electron current.

FIG. 1 shows the end-form of the above-described HfC emitter 10 before it is placed in operation. Emitter 10 has an apex 12 with a 250 nm radius rounded tip 14. HfC emitters 10 are formed from single crystal rods manufactured through a floating zone refining process. These rods are made from transition metal carbides, e.g., HfC, and are grown to a specific crystallographic orientation, e.g., (110) crystallographic direction on axis. These rods are then centerless ground and cut to length. The end of each rod is electrochemically etched to form a cuspate shape with an apex, as shown in FIG. 1. The shank of this needle is mounted in a Vogel mount so that tip heating may be accomplished. The result is an emitter having a rounded end-form tip with a small radius of curvature, as shown in FIG. 1.

Figure 2:
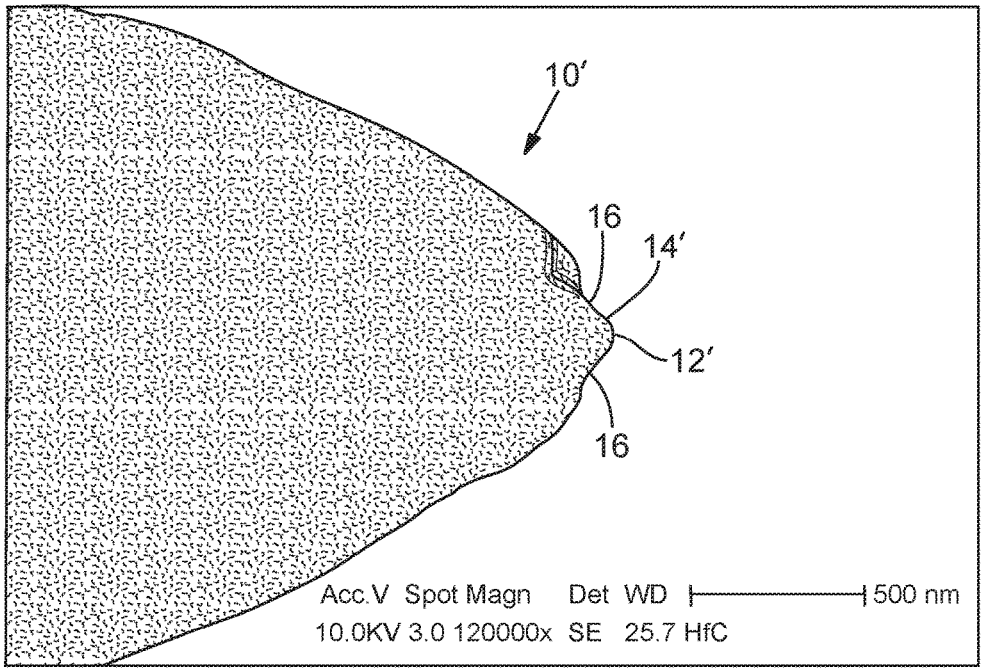
FIG. 2 is a rendering of a magnified (120000×) SEM micrograph image showing a side elevation view of the sharp end-form shape developed at the apex of the electrochemically etched HfC(110) field emission electron source of FIG. 1 after about 40 hours of operation.
Figure 3:
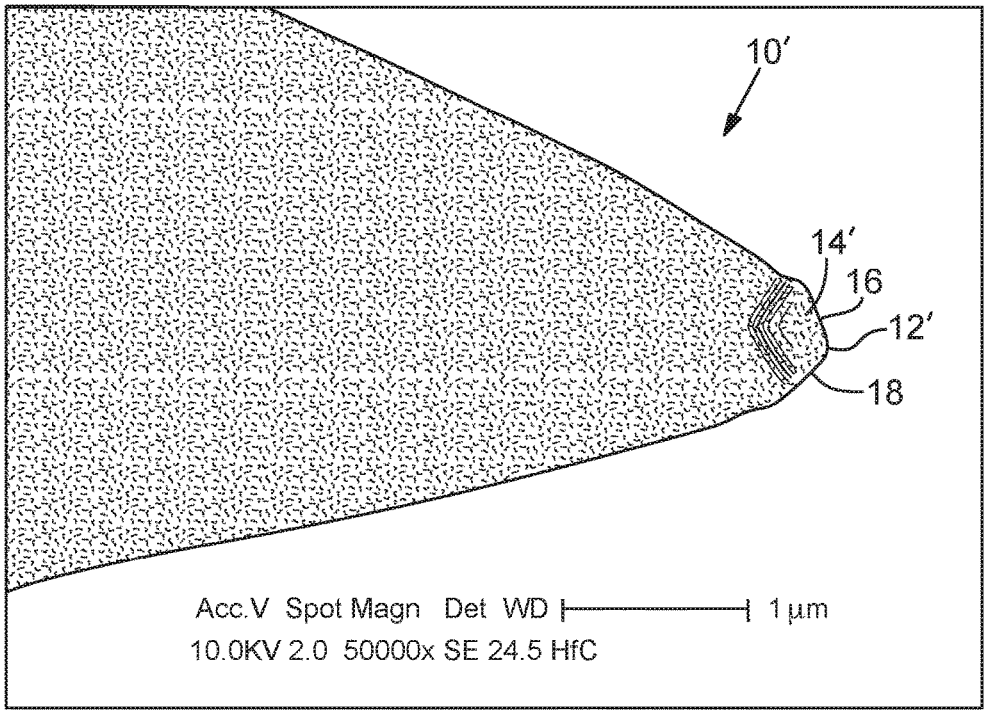
FIG. 3 is a rendering of the SEM micrograph image of the HfC(110) field emission electron source of FIG. 2, shown with a 50000× reduced magnification to emphasize sharp edges of the emitter end-form.
Figure 4:
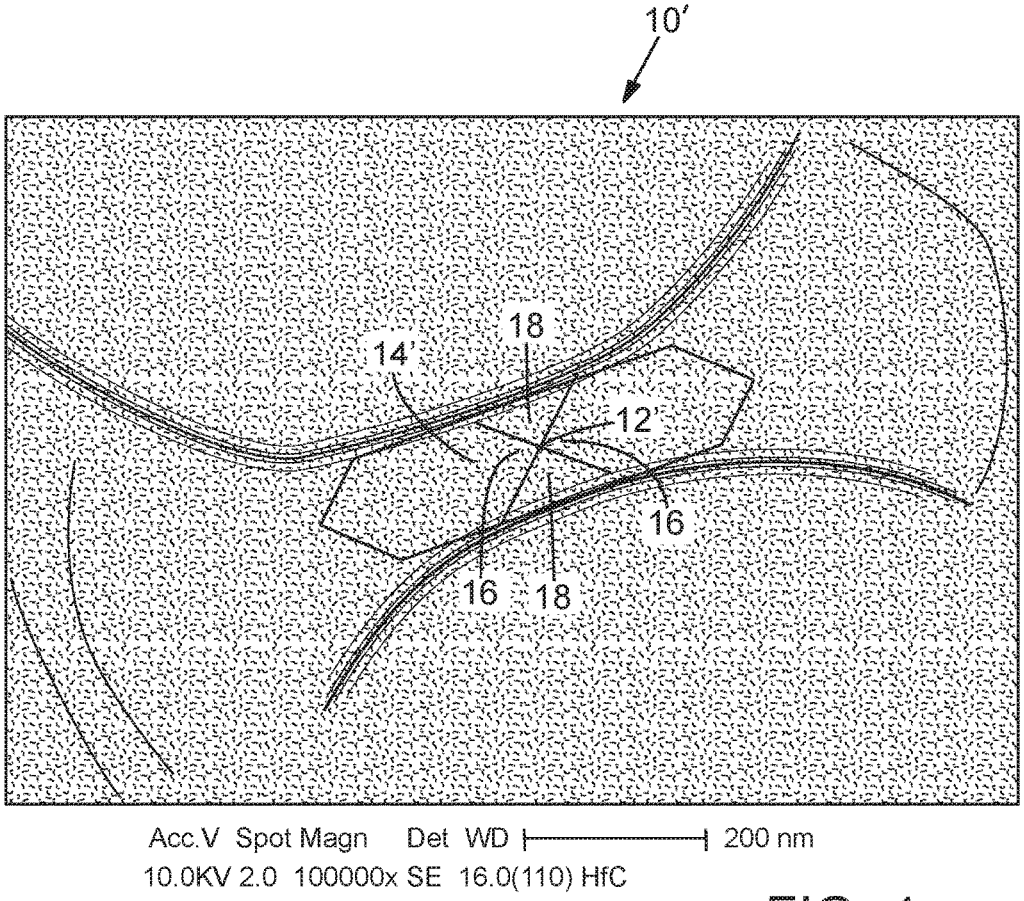
FIG. 4 is a rendering of a magnified (100000×) SEM micrograph image showing a top-down plan view, on which superimposed straight lines show the crystallographic planes, of the sharp end-form of the HfC(110) field emission electron source of FIG. 2.

FIG. 2 shows the end-form of an HfC emitter 10', which represents HfC emitter 10 after 40 hours of operation at a high temperature of between about 1850° K and about 1900° K producing about 1.0-2.0 mA/sr angular intensity of emission. Tip 14 of emitter 10 shown in FIG. 1 has been re-formed such that the (110) plane has an apex 12' with a relatively sharp central protrusion or small (about 55 nm)-radius tip 14' encompassed by planar features of angular shape. Specifically, tip 14' is formed at a slightly rounded corner of a distorted cube defined by the intersection of four planes, two (100) planes 16 and two (111) planes 18 (FIG. 4). FIG. 3 shows with lesser magnification the sharp edges of (100) planes 16 and (111) planes 18 forming apex 12'. FIG. 4 shows apex 12' of HfC emitter 10' as viewed straight top-down. FIG. 4 has straight lines superimposed on the rendering to delineate crystallographic (100) planes 16 and crystallographic (111) planes 18 of the sharp end-form of HfC emitter 10'.

The angular formation is uniform circumferentially around tip 14'. After burn-in, applying a beam voltage to the HfC group thermionic-enhanced field emission electron source can produce from about 0.5 mA/sr to about 5.0 mA/sr (or greater) electron beam emission and from about 30 μA to about 60 μA total electron emission.

It will be obvious to those having skill in the art that many changes may be made to the details of the above-described embodiments without departing from the underlying principles thereof. The scope of the invention should, therefore, be determined only by the following claims.

The invention claimed is:

1. A method of making a source of thermal-enhanced field emission, comprising:

forming an electron emitter having an apex including an initial tip of rounded end-form on a substrate made of a transition metal carbide material of high refractory nature, the initial tip having a radius of curvature of not greater than 300 nm in an initially low field crystallographic orientation for electron emission; and operating the electron emitter at a high electron beam current and at a high temperature for a time sufficient to impart to the apex a geometrical change that develops a very high field emission orientation, the geometrical change imparted to the apex resulting in a change in the initial tip to a relatively sharp central protrusion that has a radius of curvature of less than about 100 nm and is encompassed by planar features, thereby allowing for a very high electric field and consequent high on-axis electron emission.

2. The method of claim 1, in which the initially low field crystallographic orientation is a (110) plane.

3. The method of claim 2, in which the radius of curvature of the initial tip is between about 100 nm and about 200 nm, and the relatively sharp central protrusion is formed at a corner of a distorted cube defined by an intersection of two (100) planes and two (111) planes of the substrate.

4. The method of claim 3, in which the radius of curvature of the relatively sharp central protrusion is between about 20 nm and about 80 nm.

5. The method of claim 1, in which the radius of curvature of the initial tip is between about 50 nm and 300 nm.

6. The method of claim 1, in which transition metal carbide material is selected from a group consisting essentially of HfC, ZrC, TiC, VC, NbC, and TaC.

7. The method of claim 1, in which the substrate is in the form of a single crystal rod.

8. The method of claim 1, in which the high electron beam current is about 0.5 mA/sr or greater and the high temperature is between about 1850° K and about 1900° K.

9. The method of claim 1, in which, during operation after formation of the relatively sharp central protrusion, an applied beam voltage produces electron beam emission at angular intensity levels of between about 0.5 mA/sr and about 5.0 mA/sr.

10. The method of claim 1, in which, during operation, an applied beam voltage produces total electron emission of between about 30 μA and about 60 μA.

11. A source of thermal-enhanced field emission, comprising:

an electron emitter including a tip having a free end that terminates in an apex, the tip formed on a substrate made of a transition metal carbide material of high refractory nature, the tip encompassed by planar features, and the tip, at the apex, characterized by a relatively sharp central protrusion that has a radius of curvature of less than about 100 nm in a high field crystallographic orientation for electron emission, thereby allowing for a very high electric field and consequent high on-axis electron emission.

12. The source of claim 11, in which the high field crystallographic orientation for electron emission is a (110) plane.

13. The source of claim 12, in which the relatively sharp central protrusion is formed at a corner of a distorted cube defined by an intersection of two (100) planes and two (111) planes of the substrate.

14. The source of claim 13, in which the radius of curvature of the relatively sharp central protrusion is between about 20 nm and about 80 nm.

15. The source of claim 11, in which the transition metal carbide material is selected from a group consisting essentially of HfC, ZrC, TiC, VC, NbC, and TaC.

16. The source of claim 11, in which the substrate is in the form of a single crystal rod.

17. The source of claim 11, in which, during operation, an applied beam voltage produces electron beam emission at angular intensity levels of between about 0.5 mA/sr and about 5.0 mA/sr.

18. The source of claim 11, in which, during operation, an applied beam voltage produces total electron emission of between about 30 μA and about 60 μA.

* * * * *